United States Patent [19]

Lyke

[11] 4,216,971

[45] Aug. 12, 1980

[54] PSYCHOLOGICAL GAME APPARATUS

[76] Inventor: Hiram J. Lyke, 14180 Crabapple Rd., Golden, Colo. 80401

[21] Appl. No.: 888,021

[22] Filed: Mar. 20, 1978

[51] Int. Cl.[2] ..... A63F 3/00

[52] U.S. Cl. ..... 273/243

[58] Field of Search ..... 273/243, 256, 288

[56] References Cited

U.S. PATENT DOCUMENTS

| | | | |
|---|---|---|---|
| 2,026,082 | 12/1935 | Darrow | 273/256 |
| 3,223,420 | 12/1965 | Turner | 273/256 |
| 3,885,792 | 5/1975 | Breslow | 273/256 |
| 4,013,294 | 3/1977 | Smeda | 273/243 |

FOREIGN PATENT DOCUMENTS

| | | | |
|---|---|---|---|
| 253492 | of 1948 | Switzerland | 273/288 |
| 801964 | of 1958 | United Kingdom | 273/243 |

*Primary Examiner*—Richard C. Pinkham
*Assistant Examiner*—R. Carl Moy
*Attorney, Agent, or Firm*—Ancel W. Lewis, Jr.

[57] ABSTRACT

A competitive game apparatus for two or more players that simulates human life and the psychological effects of different human experiences. The game apparatus includes a board having a plurality of alternative routes, each with a plurality of stations with reward, penalty, and chance indicia printed thereon and a plurality of favorable and unfavorable personality tokens representative of personality enrichment. The accumulation of favorable personality tokens enables the acquisition of each of the buttons required to win the game. Playing pieces are moved from station to station by the players as determined by a chance device, and the favorable and unfavorable personality tokens can be won or lost. A general route has a plurality of interconnected stations by which a player has the opportunity to accumulate all types of available personality tokens. In addition there are alternate psyche trip routes with a plurality of interconnected stations that represent endeavors such as education, business, and society, in which a player can acquire only one type of personality tokens on each route. A zapping procedure representative of aggression allows one player to impose penalties on the other players.

28 Claims, 16 Drawing Figures

WINNING NUMBERS! 2, 5, 6, 7, 8 OR 12

PSYCHOLOGICAL GAME APPARATUS

FIELD OF THE INVENTION

This invention relates generally to games and more particularly to a novel game apparatus specifically adapted to depict human life and the psychological effects of human experiences.

BACKGROUND OF THE INVENTION

The background and general philosophy of the game of the present invention is based on the recognition that everybody wants a psychologically effective life. The success of a person depends to a large extent upon a person's ability to recognize and take advantage of opportunities. One may miss these opportunities or may go overboard in psychological investments, risk all in order to experience life to the utmost, or may be devastated by someone else's aggression. A person typically will invest part of his psychological self in order to feel good about himself. As a person makes wise decisions, the person feels good about himself. If that person spends time unwisely he will usually lose personal esteem. A person may be good at business or at intellectual endeavors or may achieve self-esteem from social acceptance. A person may seek psychological inner peace by entering therapy.

The game of the present invention mirrors human experiences and offers choices and involves risks and rewards. Basically, the player accumulates personality tokens which represent enrichment of this personality. If the player wins he achieves psychological well-being.

A variety of different types of game apparatus, and particularly board-type games in which playing pieces are moved from station to station over a game board, have heretofore been provided. No presently known game is available that specifically simulates different human experiences and deals specifically with the psychological effects of human experiences.

Accordingly, it is a general object of the present invention to provide game apparatus that simulates the experiences encountered in real life and the various psychological effects of different human experiences.

Another object of the present invention is to provide a game that affords a high level of interest and enjoyment for the players and in addition is a useful educational and therapeutic tool.

Still a further object of the present invention is to provide a psychological game characterized by the accumulation of buttons and personality tokens that represent personality enrichment.

In acquiring the game buttons and personality tokens the players must choose between different routes which involve different rewards and risks. Success in the game, which is analogous to psychological well-being, depends on a player's ability to recognize and take advantage of opportunities and in his willingness and success in making decisions and taking risks.

SUMMARY OF THE INVENTION

The apparatus of the present invention generally comprises a game board with a plurality of alternative routes each having a plurality of indicia-bearing stations, a chance device, a special playing piece for each player, sets of favorable and unfavorable personality tokens, sets of indicia-bearing chance cards, and sets of four game buttons which must be acquired to win the game. The stations have indicia for directing a player whose game piece lands on the station. Generally, the indicia denotes an experience and may either reward the player by awarding favorable personality tokens or game buttons or penalize the player by taking away personality tokens or by awarding unfavorable personality tokens. In addition, the indicia offers the player choice between different game strategies or instructs the player to select a chance card where there is further indicia involving a reward or penalty. The movement of the playing pieces from station to station is determined by the player's use of a chance device such as rolling dice.

One course of travel or trip route along the outer peripheral edge of the game board represents a more general route in which the players have an opportunity to acquire all types of available personality tokens to develop an "OK" personality. In addition, there are alternate psyche courses of travel or trip routes located inside the outer track that are short cuts in getting specific personality tokens. Each of the shortcut psyche routes to an "OK" personality represents an endeavor such as business, education, society, or therapy, through which an individual acquires a psychologically fulfilling life. There is also a zapping procedure representative of aggression in which one player may impose penalties on the other players.

Other objects, advantages and capabilities of the present invention will become more apparent as the description proceeds, taken in conjunction with the accompanying drawings in which like parts have similar reference numerals and in which.

Figure 1:
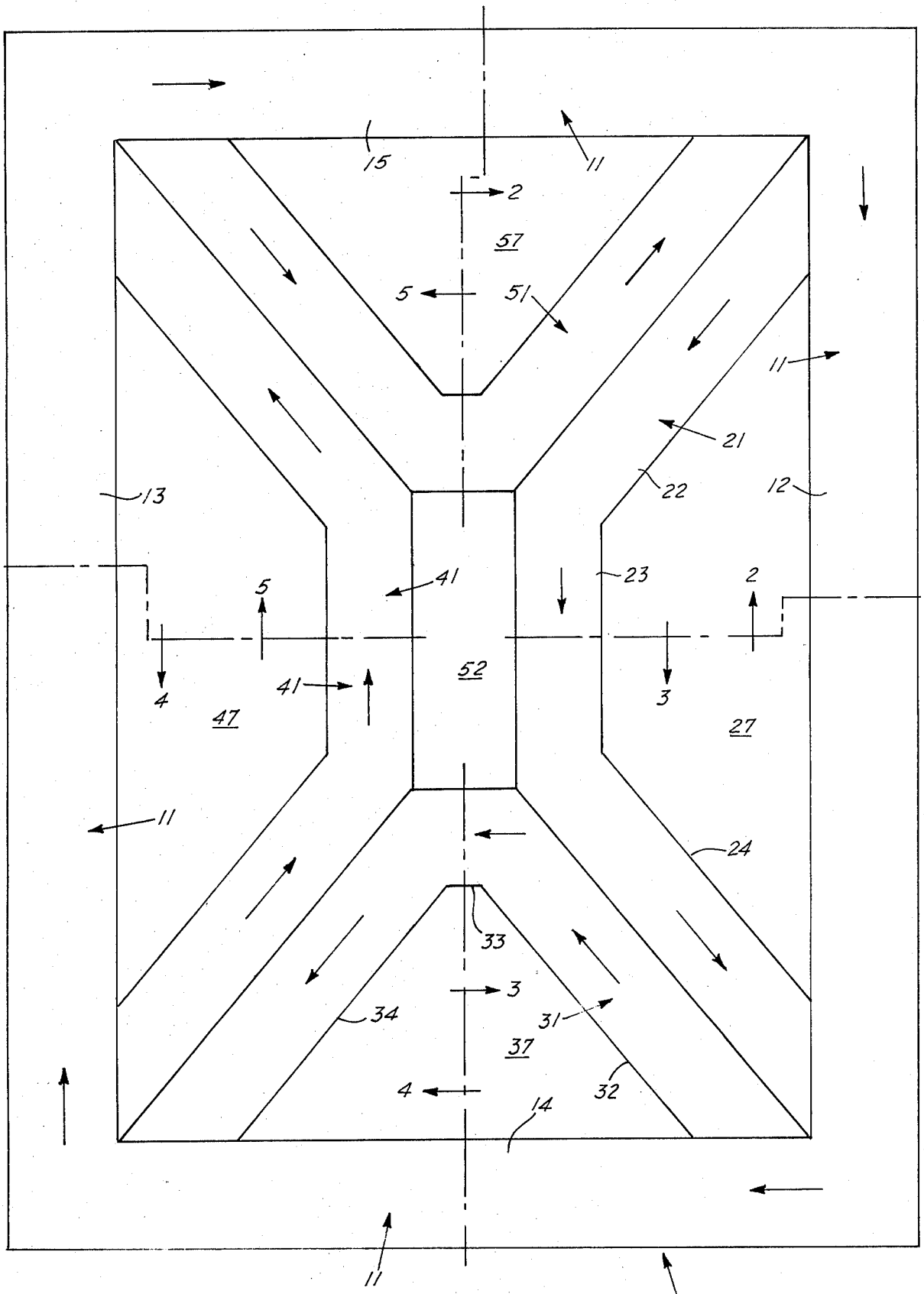
FIG. 1 is a top plan view of a game board arranged in accordance with the present invention without the details of each station shown.
Figure 2:
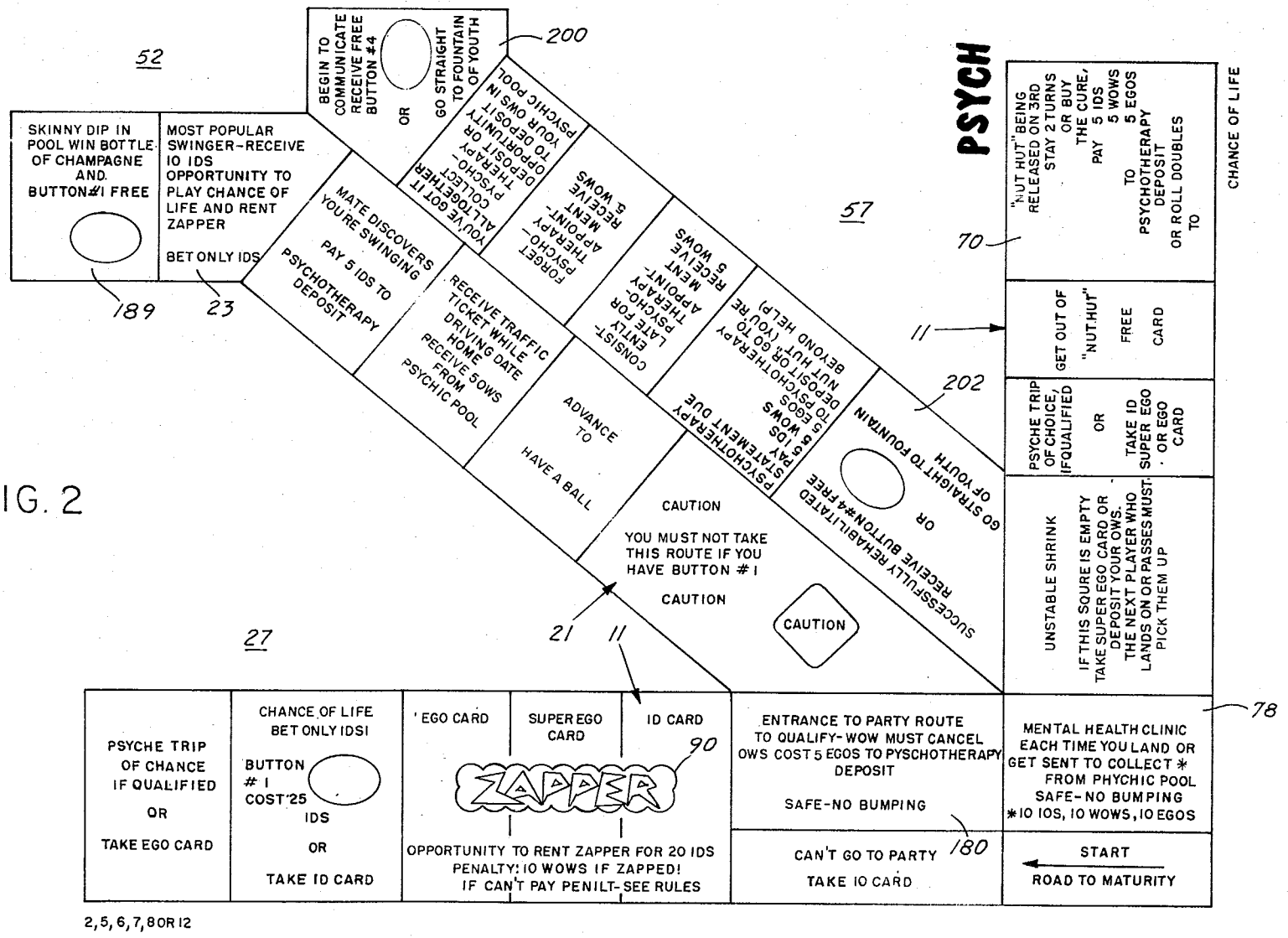
FIG. 2 is a top plan view of an approximately one-fourth segment of the game board taken along lines 2—2 of FIG. 1 showing details of the various stations.
Figure 3:
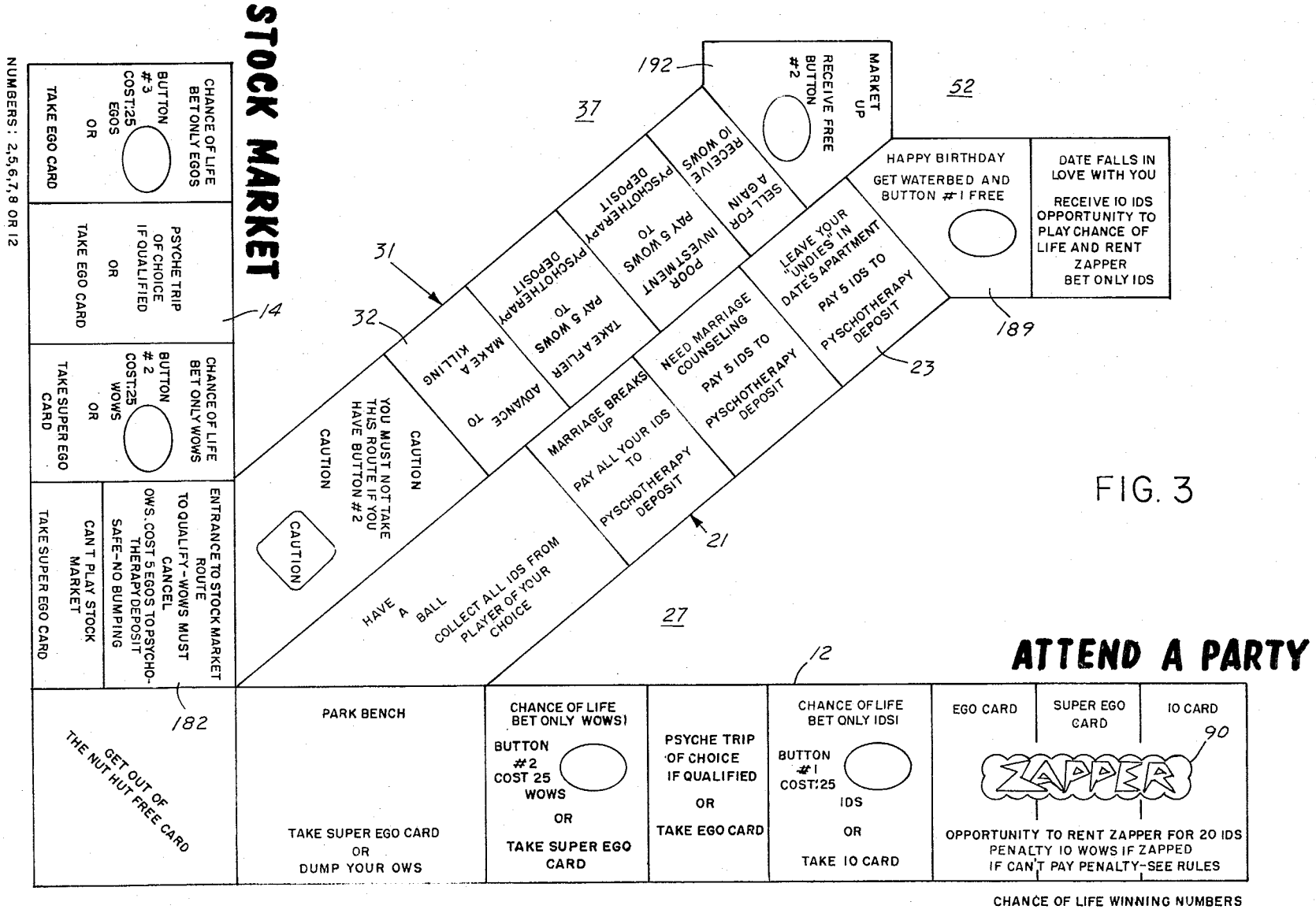
FIG. 3 is a top plan view of a second segment of the game board to one side of lines 3—3 of FIG. 1.
Figure 4:
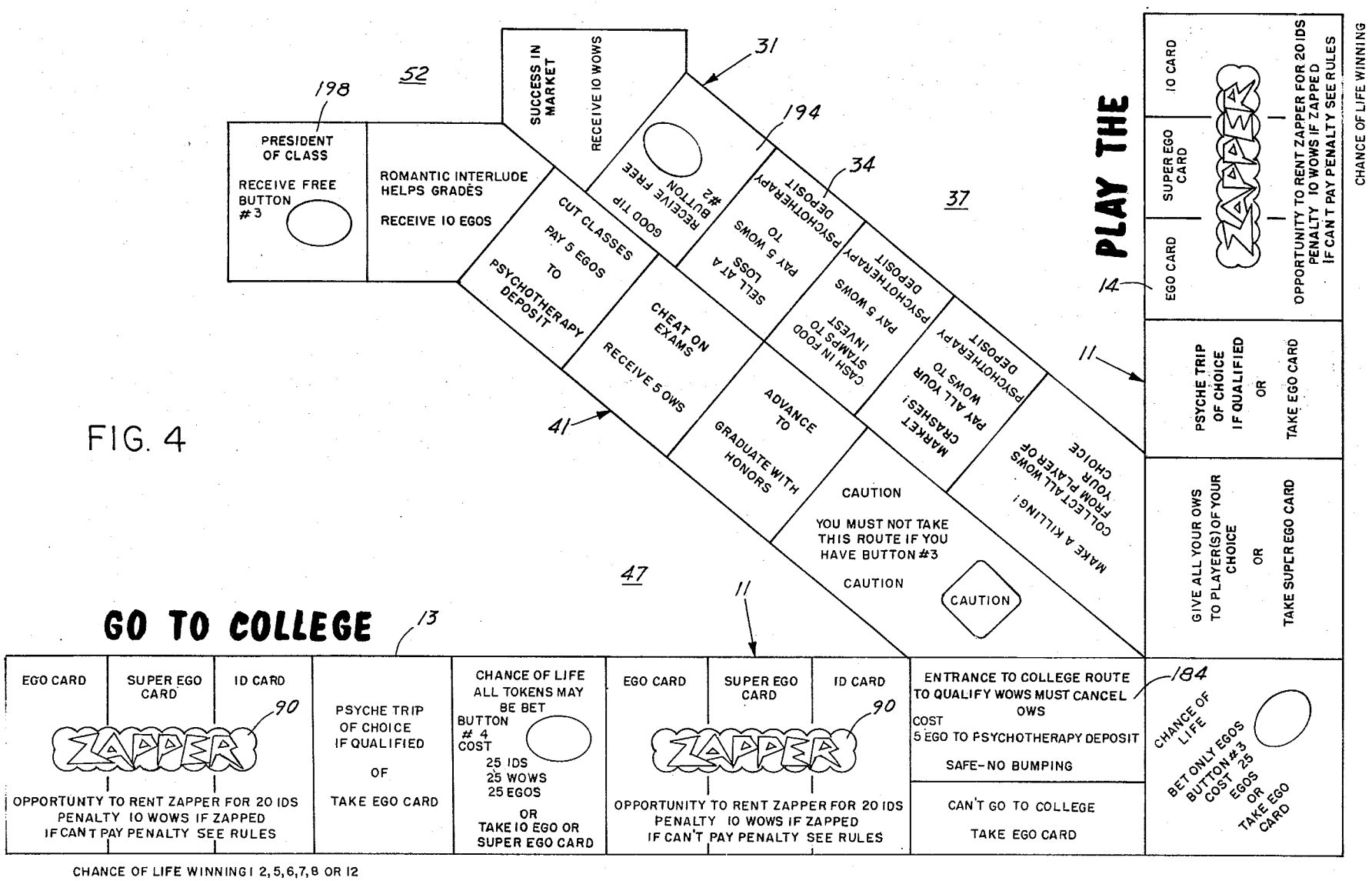
FIG. 4 is a top plan view of a third segment of the game board to one side of lines 4—4 of FIG. 1.
Figure 5:
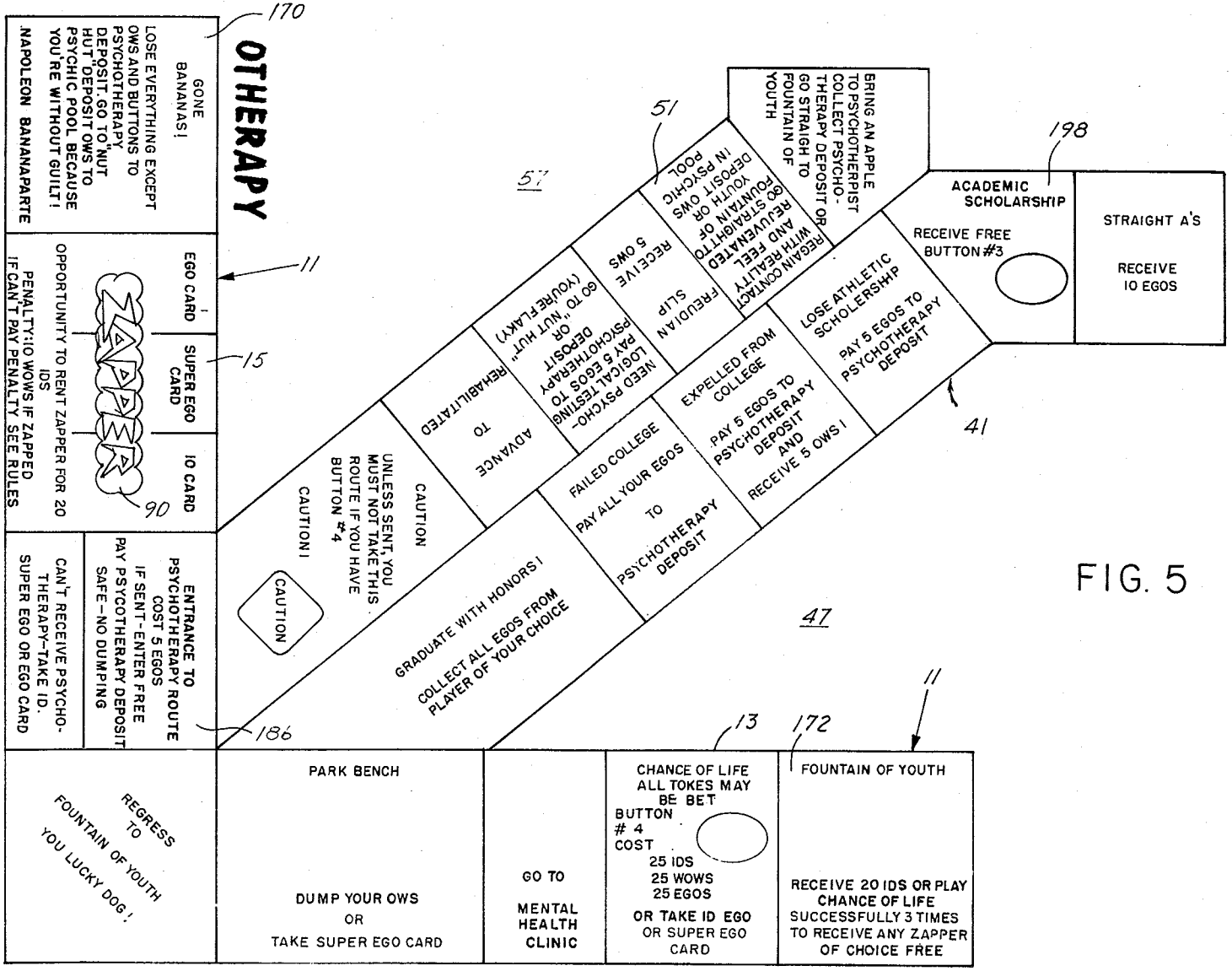
FIG. 5 is a top plan view of a fourth segment of the game board to one side of lines 5—5 of FIG. 1.

Referring now to the drawings, a peripheral route 11, herein referred to as the "general" route and also designated as the "road to maturity", is disposed along the entire outer peripheral edge of the rectangular game board 10 so as to be of an open, rectangular shape and includes a pair of opposed, spaced, parallel side portions 12 and 13 and a pair of opposed, spaced end portions 14 and 15.

An inside route 21, herein designated the "party" route, is located inside the general route 11 opposite side portion 12 and includes an end portion 22 which extends in at an angle to the end of side portion 12, an intermediate portion 23 that extends along and in spaced parallel relation to side portion 12, and an end portion 24 which extends back out at an angle to the side portion 12 to provide an alternate route to side portion 12.

Another inside route 31, herein designated the "stock market" route, is located inside the general route 11 opposite end portion 14 and includes an end portion 32 which extends in at an angle to the end of end portion 14, an intermediate portion 33 that extends along and in spaced parallel relation to end portion 14, and an end portion 34 that extends back out at an angle to the end portion 14 to provide an alternate route to end portion 14.

Another inside route 41, herein designated the "college" route, opposite side portion 13 of the general route has a shape similar to route 21 and provides an alternate route to side portion 13. Yet another inside route 51, herein referred to as the "psychotherapy" route, is opposite side portion 15 of the general route and has a shape similar to route 31 and provides an alternate route to portion 15. The intermediate portions of these inside routes form a rectangular center portion 52. Each of the inside routes 21, 31, 41 and 51 and associated side and end portions form truncated triangular portions designated by numerals 27, 37, 47 and 57, respectively.

The general route 11 is further characterized as a route in which the player has an opportunity to acquire all of the available personality tokens, while the party route 21, stock market route 31, college route 41 and psychotherapy route 51 are further characterized as psyche trip routes in which the player is limited in the case of the first three to acquiring only one type of personality token and in the case of the latter can acquire all types of personality tokens.

In general, a player may move his playing piece described hereinafter along the various routes in the direction indicated by the arrows. As will hereinafter be explained, a player determines how many stations to move his playing piece by a chance device. A player may elect to play on the outer general route 11 on which all of the game buttons and personality tokens described hereinafter can be acquired or on one of the inner psyche trip routes on which game buttons and personality tokens can be acquired.

Party route 21 is representative of a person's social life, stock market route 31 is representative of business endeavors, college route 41 is representative of educational endeavors, and psychotherapy route 51 is representative of psychotherapeutic treatment. The indicia on the stations described hereinafter of each of the routes generally corresponds to the theme of the route.

Referring now to FIGS. 2–5, each of the routes has a plurality of stations, each with indicia thereon which generally may either penalize or reward a player by awarding favorable or unfavorable personality tokens, or may instruct or make a decision available to a player whose playing piece lands on the station. In addition, the indicia generally relates an experience corresponding to the theme of the route that might bring about the reward or penalty stated and its resultant psychological effect. For instance, on the stations of the college route 41, some of the experience-related indicia corresponding to penalties are: CHEAT ON EXAMS, CUT CLASSES, LOSE ATHLETIC SCHOLARSHIP, FAILED COLLEGE. On the stations of the stock market route 41 the experience indicia include MARKET UP, SELL AT A LOSS, MARKET CRASHES, SUCCESS IN MARKET. Likewise, on the party route 21 and psychotherapy route 51 the station indicia generally relate experiences that correspond to the reward or penalty instructed.

Figure 6:
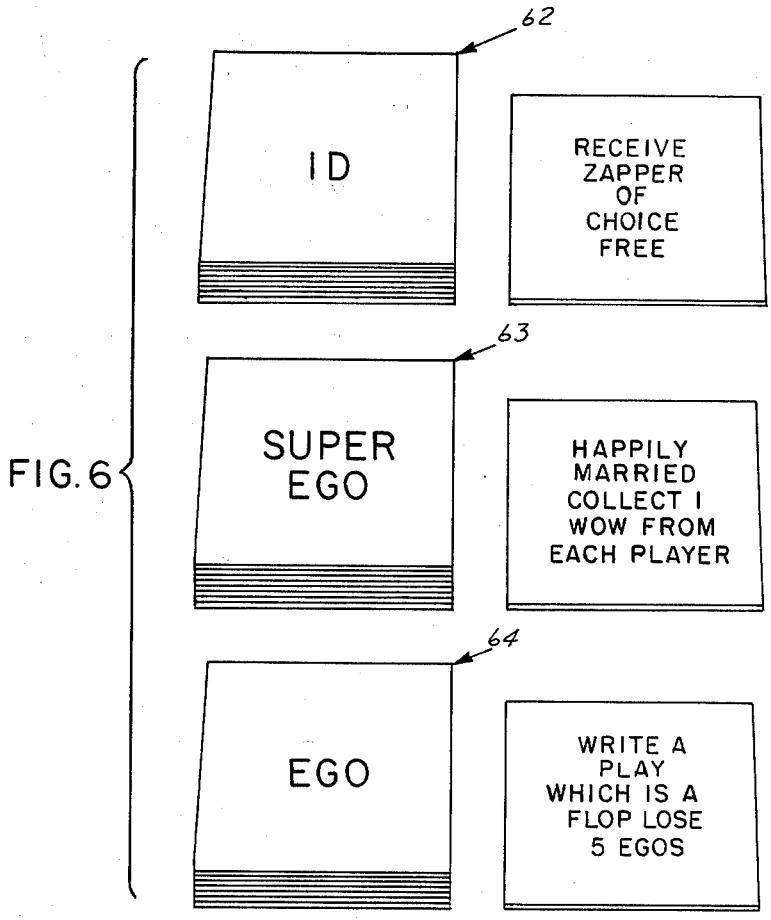
FIG. 6 is a perspective view of three sets of stacks of chance cards having one representative card overturned to illustrate sample indicia thereon.
Figure 7:
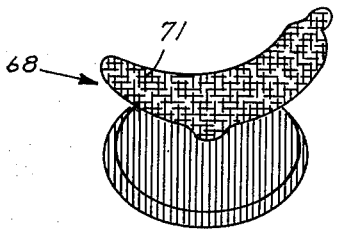
FIG. 7 is a perspective view of one assembled playing piece having a base with one color code.

The indicia on some stations of the game board 10 instruct the player to select a chance card from one of three sets of chance cards shown in FIG. 6. One set of chance cards 62 is designated ID. Another set of chance cards 63 is designated SUPER EGO, and the third set of chance cards 64 is designated EGO, all of which have further indicia that may reward or penalize or instruct the players.

Figure 8:
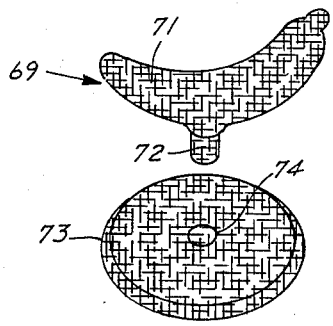
FIG. 8 is a perspective view of a disassembled playing piece having a base with another color code.
Figure 9:
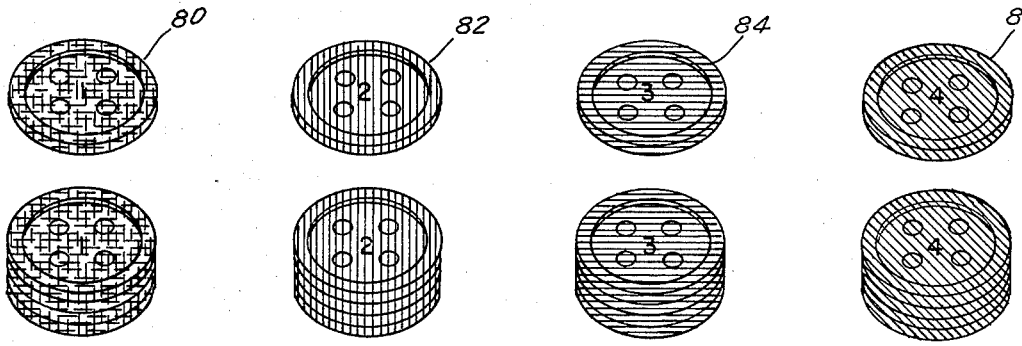
FIG. 9 is a perspective view of several sets of stacked game buttons, each set with a different color code and number, with the top of each raised above the others for illustration purposes.
Figure 10:
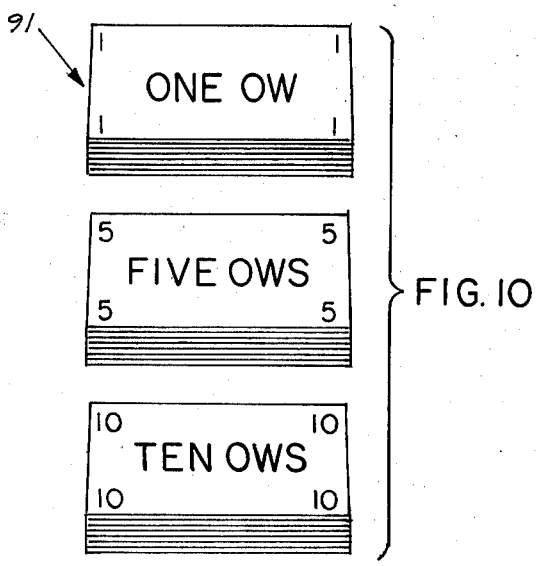
FIG. 10 is a perspective view of a set of stacks of OW personality tokens.
Figure 11:
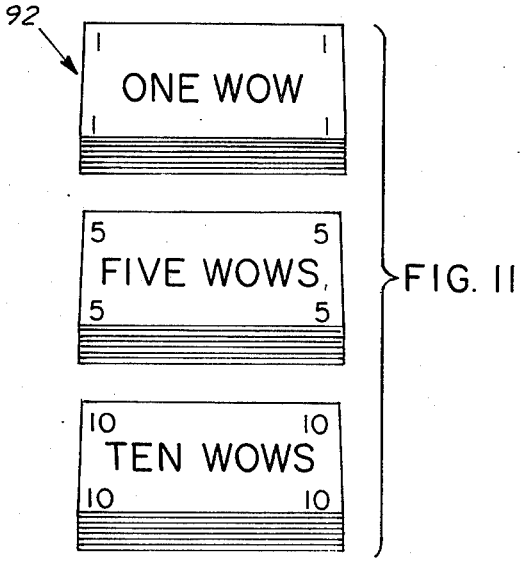
FIG. 11 is a perspective view of a set of stacks of WOW personality tokens.
Figure 12:
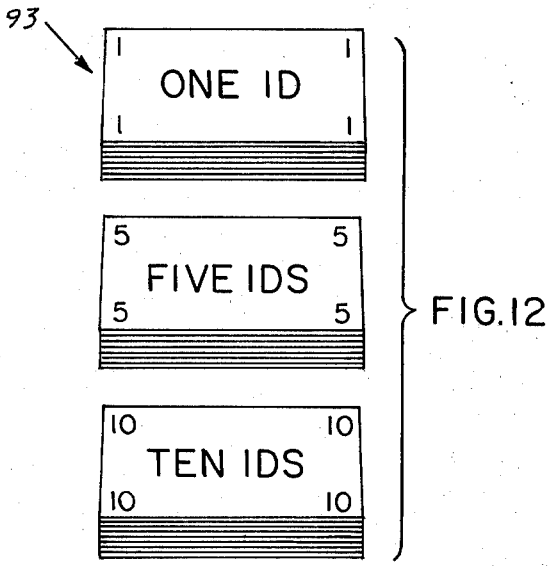
FIG. 12 is a perspective view of a set of stacks of ID personality tokens.
Figure 13:
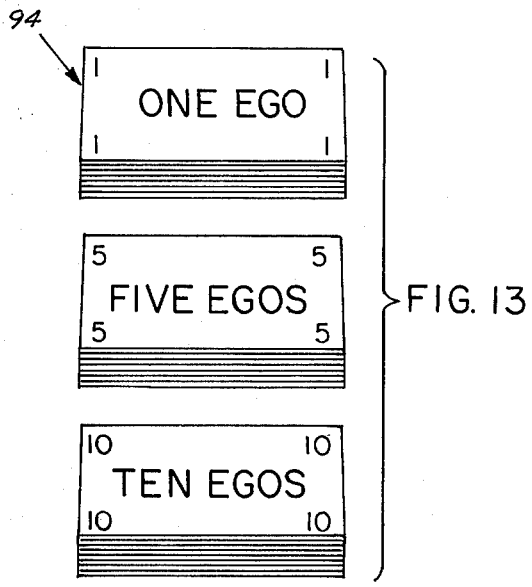
FIG. 13 is a perspective view of a set of stacks of EGO personality tokens.

Referring to FIGS. 8 and 9, playing pieces 68 and 69 of the invention are shown. Each playing piece has a body portion 71 in the shape of a banana with a stem 72 that inserts into a disc-shaped base 73 with an aperture 74 in a friction-fitting engagement. The playing piece 68 may be fabricated from a lightweight material such as plastic and each player's playing piece 68 is of a different color, with the base of piece 68 designated red and the base of piece 69 designated yellow to distinguish their location on the game board 10.

Referring to FIG. 9, the four sets of buttons 80, 82, 84, 86 are shown. In the illustrative embodiment of the invention the buttons are generally disc-shaped and resemble ordinary buttons. Each button 80 has a number 1 designation and is color-coded yellow. Each button 82 has a number 2 designation and is color-coded red. Each button 84 has a number 3 designation and is color-coded blue. Each button 86 has a number 4 designation and is color-coded green. There are a plurality in each of the sets of the buttons and it is an object of the game for a player to acquire a complete set, one through four, of the buttons.

In FIGS. 10, 11, 12 and 13 there are shown the various personality tokens. In general, the personality tokens are acquired or lost by the players during the course of the game and represent enrichment of the player's personality. The personality tokens shown are in the form of flat cards. The various personality tokens shown in groups or sets are designated as OW tokens 91, WOW tokens 92, ID tokens 93 and EGO tokens 94. Each group of tokens is provided in one, five and ten denominations and is so designated. Moreover, for the purposes of identification each personality token is of a different color. In the preferred embodiment the OW tokens are gray, the WOW tokens red, the ID tokens yellow and the EGO tokens blue. The ID, WOW, and EGO personality tokens 93, 92, 94 represent generally favorable personality traits or experiences and the OW personality tokens 91 represent generally unfavorable personality traits or experiences.

The ID personality tokens 93 represent pleasurable experiences, the WOW personality tokens 92 represent rewards for pride in achievement, the EGO personality tokens 94 represent rewards for using one's intellect, and the unfavorable OW personality tokens 91 represent guilt feelings.

Figure 14:
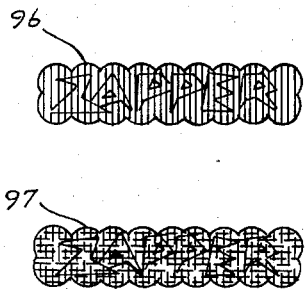
FIG. 14 is a perspective view of two ZAPPER pieces, each having a different color code.

Referring to FIG. 14, ZAPPER pieces 96 and 97, differing only in color designation, are shown. Each player is given a set of ZAPPER pieces color-matched to his playing piece. The ZAPPER pieces represent aggression and can be used on those stations designated 90 of the game board 10, marked "ZAPPER" with a corresponding external shape, as will hereinafter be explained.

Figure 15:
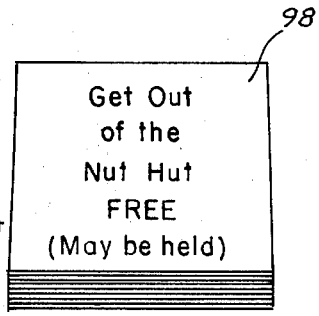
FIG. 15 is a perspective view of a stack of GET OUT OF THE NUT HUT FREE cards.
Figure 16:
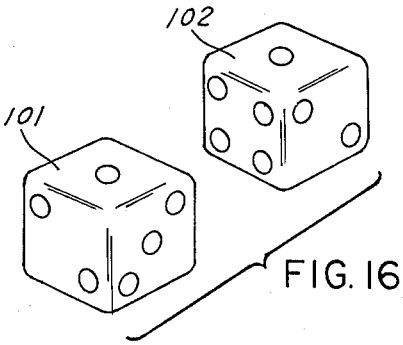
FIG. 16 is a perspective view of a set of dice.

There is shown in FIG. 15 a plurality of cards each with the indicia GET OUT OF THE NUT HUT FREE, enabling the player possessing such a card to be freed from that station on the board. The chance devices shown in FIG. 16 are two conventional dice 101 and 102.

RULES OF THE GAME

The first player to acquire all four buttons 80, 82 84 and 86 and to have as many or more favorable WOW personality tokens 92 than unfavorable OW personality tokens 91 wins the game. Each player moves his playing piece from station to station as determined by rolling the dice 101 and 102, and follows the instruction indicia on the stations. To begin the game the players start at the general route 11, but during the course of the game each player is given chances to play the psyche trip routes 21, 31, 41 and 51.

PREPARATION FOR PLAYING

Prior to starting the game, the game board 10 is placed in a flat horizontal position on a table top or the like, and all the ID chance cards 62, SUPER EGO chance cards 63, and EGO chance cards 64 are stacked at an accessible location. Preferably there are at least two but not more than six individual players age sixteen and up. Each player is issued a game playing piece 68 or 69, etc., with a color-matched set of ZAPPER pieces 96, 97, etc.

To begin the game each player is issued ten ID, ten WOW, and ten EGO personality tokens. The players decide who will parcel out the various personality tokens 91, 92, 93, 94 and buttons 80, 82, 84, 86 when the game instructions so indicate, and that player is termed the "Junior Therapist." The resource from which the various personality tokens are drawn out is termed the PSYCHIC POOL. The deposit to which penalty tokens are paid when required by the instructions is termed the "PSYCHOTHERAPY DEPOSIT." Starting with the Junior Therapist, each player in turn throws the dice and the player with the highest number starts the play.

START

Play is started from station 78 marked MENTAL HEALTH CLINIC. The players all place their playing pieces on this station and the first player rolls the dice and advances the number of stations indicated by the dice in the direction of the arrows on FIG. 1. The other players then proceed in turn.

Any player who at any time rolls doubles on the dice moves ahead to the station indicated, plays the requirements shown, and may immediately roll again and move ahead again. If, however, a player rolls doubles three times within one turn, that player must go directly to station 70 marked NUT HUT and stay there until at least the next turn.

PAYMENTS

If a player lands on a penalty station that requires favorable personality tokens to be paid as a penalty, the player must deposit the designated personality tokens in the PSYCHOTHERAPY DEPOSIT. If a player cannot pay the designated tokens, he must pay all of the designated tokens which he has to the PSYCHOTHERAPY DEPOSIT, collect five OW personality tokens 91 from the PSYCHIC POOL as a penalty, and must then go to the physchotherapy route 51, but without paying any entrance fee.

If a player owes personality tokens which go to the PSYCHOTHERAPY DEPOSIT and cannot pay them, the deficit is not to be made up from the PSYCHIC POOL.

ID, EGO, SUPER EGO

If a player lands on a station marked ID, SUPER EGO, or EGO and a ZAPPER piece, as will hereinafter be explained, is not in play, the player may draw the designated chance card from the chance card stacks 62, 63, 64 and carry out the instructions. Unless otherwise indicated, any rewards are obtained from the PSYCHIC POOL. Any penalties are paid to the PSYCHOTHERAPY DEPOSIT. The chance card is returned to the bottom of the proper pile.

ZAPPING

If a player lands on certain stations identified by the indicia ID, SUPER EGO, OR EGO, he may rent and thus acquire only that specific ZAPPER station by paying the required number of ID personality tokens 93, as indicated by the indicia on the station, to the PSYCHIC POOL. The player who rents a ZAPPER station is termed the renter.

A ZAPPER piece 96, 97, etc. of the appropriate color is then put across the stations. It remains there for the rest of the game, unless another player is able to rent the ZAPPER station from the PSYCHIC POOL for double its original cost. A player cannot refuse to relinquish a ZAPPER piece. A player is ZAPPED by landing on a station that has a ZAPPER piece and must pay the penalty indicated by the indicia on the station, and then may offer to rent the ZAPPER station if he has sufficient ID tokens to do so.

If a player lands on his own ZAPPER station, he selects the chance card indicated on the station. If a player lands on another player's ZAPPER station, he must pay the PSYCHIC POOL the cost of being ZAPPED as shown by the indicia on the station. If a player cannot pay the required number of WOW personality tokens 92 for being ZAPPED, he must pay the number of WOW personality tokens he has and do one of the following:

1. Take all of the renter's OW personality tokens 91.
2. Give the renter one of his buttons 80, 82, 84, 86, free of charge, providing it is not already possessed by the renter. The renter is permitted to choose any needed psyche trip free (WOW tokens need not cancel OW tokens).

In all of the above cases, if a player is ZAPPED and cannot pay the required WOW tokens 92, he receives five OW tokens 91 and must continue along the route 51.

CHANCE OF LIFE

If a player lands on the station designated CHANCE OF LIFE, he may bet the personality tokens as designated by the indicia against the PSYCHIC POOL and roll the dice. If the player rolls 2, 5, 6, 7, 8 or 12 on the dice he wins what he bet. Having won, the player may bet as long as he wins or until he has accumulated enough tokens to rent the most expensive ZAPPER station on the game board 10. Forty of each is the maximum number of tokens a player can win, however; each time a bet is made the original stake and all acquired winnings stand. If the bet is lost, everything that was at risk goes back to the PSYCHIC POOL and the betting ends. OW personality tokens 91 may not be bet when playing the CHANCE OF LIFE.

MENTAL HEALTH CLINIC

Each time a player is sent to or lands on the MENTAL HEALTH CLINIC station 78 he collects ten ID personality tokens, ten WOW personality tokens and ten EGO personality tokens from the PSYCHIC POOL.

BUMPING

Bumping is not permitted on any of the psyche trip routes 21, 31, 41 or 51 or any station marked SAFE. If a player is on any other station and another player arrives on the same station, the first player is BUMPED and goes straight to the NUT HUT station 80.

NUT HUT

If a player is sent to or lands on the NUT HUT station 70, he must stay there two turns, escaping on the third, unless:

1. The player presents a GET OUT OF THE NUT HUT FREE card 98, which he may apply on the next turn, or
2. The player rolls doubles on the dice on the next turn, whereby he is released immediately and moves forward the number shown on the dice, or
3. He may pay five EGO, five WOW, or five ID tokens to the PSYCHOTHERAPY DEPOSIT.

GONE BANANAS

If a player lands on station 170, marked GONE BANANAS, on the general route 11, or is sent to it, he loses all of his personality tokens 91, 92, 93, 94. His ID 93, EGO 94, and WOW 92 personality tokens are paid to the PSYCHOTHERAPY DEPOSIT and his WOW personality tokens 91 to the PSYCHIC POOL. The player must then go to the NUT HUT station 70.

FOUNTAIN OF YOUTH

If a player lands on the station marked FOUNTAIN OF YOUTH, station 172 on the general route 11, he may receive twenty ID tokens 93 or, alternatively, play the CHANCE OF LIFE and roll the dice. Three successful rolls of the dice permit the player to acquire immediately any ZAPPER piece of his choice from the PSYCHIC POOL or any renter.

PSYCHE TRIPS

The psyche trip routes 21, 31, 41 and 51 are in some circumstances a gamble. A player may acquire a high reward, the button he desires, or a ZAPPER piece, or his psychological growth may be impeded by losing favorable personality tokens and acquiring unfavorable OW personality tokens 91.

If a player chooses to take a psyche trip, the following requirements must be met:

1. WOW personality tokens 92 must cancel OW personality tokens 91 (except for the psychotherapy route 51).
2. A player must pay the required number of personality tokens to the PSYCHOTHERAPY DEPOSIT as designated by the indicia on the route entrance stations 180, 182, 184, 186 and must land on the entrance of a psyche trip route by the exact count of the roll of the dice or by special instructions. If a player is sent to the psychotherapy route 51 by instruction, he need not pay any personality tokens.

HOW TO GET BUTTONS

Buttons may be obtained free by taking (if qualified) the four psyche trip routes 21, 31, 41, and 51 and landing on a station identified by the indicia FREE BUTTON, i.e.:

#1 Button 80—Stations 189, 190, party psyche trip route 21.

#2 button 82—Stations 192, 194, stock market psyche trip route 31.

#3 Button 84—Stations 196, 198, college psyche trip route 41.

#4 Button 86—Stations 200, 202, psychotherapy psyche trip route 51. Buttons may also be obtained by landing on one of the CHANCE OF LIFE STATIONS on the general route 11 and forefeiting the designated number of personality tokens to the PSYCHIC POOL in exchange for a button.

If a player lands on a CHANCE OF LIFE station and does not have enough personality tokens to trade for a button, he may play the CHANCE OF LIFE and gamble that he can win enough additional tokens to buy the button.

A free button may be acquired when a player is ZAPPED and cannot pay the penalty but owns a button which the renter of the ZAPPER station desires.

HOW TO GET RID OF OW TOKENS

1. OW tokens may be left on a station marked PARK BENCH on the general route, in which case the next player to land on this station must take all of the OW personality tokens on the station and not deposit any of his own.
2. If a player lands on the station marked UNSTABLE SHRINK on the general route, he may deposit all his OW personality tokens there. The next player to land on or pass over that station must pick up all of the OW personality tokens that are there.
3. A player may land on a station or draw a chance card which gives that player permission to give his OW personality tokens to the player or players of his choice.
4. A player may have a sufficient number of WOW personality tokens to cancel out his OW personality tokens.
5. If a player rents a ZAPPER station and a zapped player cannot pay the penalty, the renter may give all of his OW personality tokens to the other player or players.
6. A player may take the psychotherapy route and land on a station which permits him to lose all his OW personality tokens to the PSYCHIC POOL.

WINNING THE GAME

Play continues until a player acquires all four game buttons 80, 82, 84, 86 and has more WOW personality tokens 92 than OW personality tokens 91.

Thus the invention provides game apparatus that simulates different experiences and their psychological effect. Although the invention has been described with a certain degree of particularly, especially with regard to the various game indicia that can be used, it is understood that the present disclosure has been made by way of example and it is anticipated that various changes, adaptations, and modifications can be made to the game apparatus and indicia without departing from the spirit thereof.

What is claimed is:

1. A game apparatus for play among players to simulate different human experiences and their psychological effects, comprising:

a plurality of tokens each representative of personality enrichment, including:

a first type of favorable personality token representing pleasurable experiences with each said first type of token having distinctive identifying indicia, a second type of favorable personality token representing rewards for using one's intellect with each said second type of token having distinctive identifying indicia;

a third type of favorable personality token representing rewards for pride in achievement with each said third type of token having distinctive identifying indicia, and unfavorable personality tokens representing guilt feelings with distinctive identifying indicia;

a plurality of decks of chance cards including:

a first deck with each card in said first deck having distinctive identifying indicia corresponding to said indicia on said first type of favorable personality token, a second deck with each card in said second deck having distinctive identifying indicia corresponding to said indicia on said second type of favorable personality token, and a third deck with each card in said third deck having distinctive identifying indicia thereon, each of said chance cards having printed matter with instructions for taking away or awarding designated said personality tokens from said players;

a game board having a plurality of routes each with a plurality of stations, said routes including:

a general route along which all types of said personality tokens may be awarded or taken away, and at least first, second and third specific routes for each of said first, second and third types of favorable personality tokens, respectively, along which only one associated type of favorable personality token may be awarded or taken away, each of said first, second and third routes having distinctive identifying indicia corresponding to said indicia on said first, second and third favorable personality tokens, respectively;

said routes having further indicia thereon, the further indicia on each route distinct from the further indicia on each other route;

a game piece for each player for movement over said routes from station to station on said game board;

chance means for determining the movement of each of said game pieces;

said stations having printed matter with instructions for awarding or taking away designated of said personality tokens from a player and representative of different human experiences; and a plurality of elements, a set of which is representative of an enriched personality, the acquisition of a set of which determines the winner of the game, at least some of said elements each having distinctive identifying indicia corresponding to said further indicia on one of said first, second, and third routes, said elements being available to a player when the player has a preselected amount of said personality tokens and lands on selected of said stations having printed matter with instructions for the acquisition of said elements.

2. A game apparatus as defined in claim 1 including rental stations having indicia thereon including printed matter which permit a player to rent the rental station and penalize another player whose playing piece lands on said rental station.

3. A game apparatus as defined in claim 2 wherein said printed matter includes the word ZAPPER.

4. A game apparatus as defined in claim 3 including a playing element having the same color as the playing piece of a player with the word ZAPPER thereon that is placed on the rental station when rented by a player.

5. A game apparatus as defined in claim 4 wherein said rental stations have indicia indicating the location of said playing element thereon.

6. A game apparatus as set forth in claim 1 wherein said general route is generally rectangular in shape with a pair of opposed side portions and a pair of opposed end portions and wherein four specific routes are located inside said general route, each of said specific routes extending from a corner in toward the center and back out from one of said side and end portions.

7. A game apparatus as set forth in claim 1 wherein each of said playing pieces has a portion in the shape of a banana that is releasably fastened to a base that is color-coded with a different color for each player.

8. A game apparatus as set forth in claim 1 wherein said distinctive identifying indicia for said first, second and third types of favorable personality tokens includes a distinctive color.

9. A game apparatus as set forth in claim 1 wherein said distinctive identifying indicia for said first type of favorable personality tokens and the corresponding first deck of chance cards and corresponding first route includes the word ID.

10. A game apparatus as set forth in claim 1 wherein said distinctive identifying indicia for said second type of favorable personality token and the corresponding second deck of chance cards and corresponding second route includes the word EGO.

11. A game apparatus as set forth in claim 1 wherein said distinctive identifying indicia for said third type of favorable personality token and the corresponding third route includes the word WOW.

12. A game apparatus as set forth in claim 1 wherein said third type of chance card includes the words SUPER EGO.

13. A game apparatus as set forth in claim 1 wherein said distinctive identifying indicia for said unfavorable personality token includes the word OW.

14. A game apparatus as set forth in claim 1 including a fourth specific route having distinctive identifying indicia.

15. A game apparatus as defined in claim 14 wherein said fourth specific route is identified as the PSYCHOTHERAPY ROUTE.

16. A game apparatus as set forth in claim 1 wherein each of said enriched personality elements takes the form of a button.

17. A game apparatus as defined in claim 1 wherein one of said stations has printed matter indicating the player has gone insane.

18. A game apparatus as defined in claim 17 wherein said one station is identified by the term GONE BANANAS.

19. A game apparatus as defined in claim 1 wherein certain of said stations have printed matter enabling said player to use said chance means to gamble to obtain additional of said favorable personality tokens.

20. A game apparatus as defined in claim 19 wherein said chance means are in the form of a die and the winner is awarded tokens only for certain selected numbers on said die.

21. A game apparatus as defined in claim 19 wherein said printed matter includes the words CHANCE OF LIFE.

22. A game apparatus as defined in claim 1 wherein said first specific route is identified as the PARTY ROUTE.

23. A game apparatus as defined in claim 1 wherein said second specific route is identified as the COLLEGE ROUTE.

24. A game apparatus as defined in claim 1 wherein said third specific route is identified as the STOCK MARKET ROUTE.

25. A game apparatus as defined in claim 1 wherein one of said stations is identified by the words FOUNTAIN OF YOUTH.

26. A game apparatus as defined in claim 1 wherein one of said stations is identified by the words NUT HUT.

27. A game apparatus as defined in claim 26 including a deck of cards with printed matter enabling the player to get out of the NUT HUT free.

28. A game apparatus as defined in claim 1 wherein one of said stations is identified by the words MENTAL HEALTH CLINIC.

* * * * *